United States Patent [19]

Dade

[11] 3,993,273

[45] Nov. 23, 1976

[54] SPACERS FOR VERTICALLY MOORED PLATFORM RISER BUNDLES

[75] Inventor: John Thomas Dade, Houston, Tex.

[73] Assignee: Standard Oil Company (Indiana), Chicago, Ill.

[22] Filed: July 28, 1975

[21] Appl. No.: 599,907

[52] U.S. Cl. ..... 61/88; 248/68 R; 248/56

[51] Int. Cl.[2] ..... E02B 17/06

[58] Field of Search ..... 248/68; 114/.5 D; 61/46.5, 46.6; 166/.5, .6

[56] References Cited

UNITED STATES PATENTS

| | | | |
|---|---|---|---|
| 2,906,100 | 9/1959 | DeLong et al. | 61/46.5 |
| 2,960,832 | 11/1960 | Hayward | 61/46.5 |
| 3,064,437 | 11/1962 | Knapp | 61/46.5 |
| 3,593,530 | 7/1971 | Pogonowski | 61/46.5 |
| 3,648,638 | 3/1972 | Blenkarn | 114/.5 D |

*Primary Examiner*—J. Franklin Foss
*Attorney, Agent, or Firm*—John D. Gassett

[57] ABSTRACT

This invention relates to a structure floating on a body of water and particularly a structure for drilling or producing wells from below the water. Buoyant members support at least a part of the structure above the surface of the water. The structure is connected to anchors or weights in the floor of the body of the water by a series of parallel leg members, usually four in number, forming a rectangular spacing. Each leg member is composed of a plurality of elongated members, such as large-diameter pipe, usually called risers. These risers are parallel. Vertically spaced spacers are provided along the riser of each leg to maintain the risers a fixed distance apart and to change the natural or resonant frequency of the individual riser pipes to be greater than the flutter frequency caused by the motion of the water past the riser. Novel spacers are provided and described which can be set in place without use of divers.

6 Claims, 8 Drawing Figures

SPACERS FOR VERTICALLY MOORED PLATFORM RISER BUNDLES

BACKGROUND OF THE INVENTION

1. Field of the Invention

This invention relates to a structure floating on a body of water. More particularly, the invention relates to a floating structure from which drilling or production operations are carried out. In its more specific aspects, the invention concerns a floating structure having buoyancy means for supporting the structure and is anchored to the ocean floor by parallel, elongated members, and means are taught for providing spacers to such elongated members.

2. Setting of the Invention

In recent years, there has been considerable attention attracted to the drilling and production of wells located in water. Wells may be drilled in the ocean floor from either fixed platforms in relatively shallow water, or from floating structures or vessels in deeper water. The most common means of anchoring fixed platforms includes the driving or otherwise anchoring of long piles in the ocean floor. Such piles extend above the surface of the water and support a platform attached to the top of the piles. This works fairly well in shallow water, but, as the water gets deeper, the problem of design and accompanying cost become prohibitive. In deeper water, it is common practice to drill from a floating structure.

In recent years, attention has been directed toward the many different kinds of floating structures from which underwater wells can be drilled. One such drilling structure is referred to as the "Vertically Moored Platform," and is described in U.S. Pat. No. 3,648,638, issued Mar. 14, 1972, Kenneth A. Blenkarn, inventor. In the Vertically Moored Platform, a structure is supported above the surface of the water by buoyant members. The buoyant members are connected to anchors in the floor of the body of water by elongated leg members which are parallel. There are no other anchoring means.

BRIEF DESCRIPTION OF THE INVENTION

This invention concerns anchoring a floating offshore structure at a selected location in a body of water having a maximum design wave and current at such location. An anchor is provided at the bottom of the body of water at the selected location. Then, a plurality of parallel, spaced-apart legs connect the offshore floating structure with the anchor. In some cases, this anchor can be a large mass called a gravity base. Each of the legs includes a plurality of parallel, elongated members, usually large-diameter pipes, commonly called risers, under tension. This invention especially concerns a plurality of novel spacers or centralizing means which are to be set at vertically spaced intervals along the risers in each leg. This is necessary for several reasons, such as holding the elongated members in a fixed position with respect to each other at a position at which the spacing is provided.

In one embodiment using the present invention, a gravity base is supported just below the floating structure by the lowermost section or ends of the riser pipes. The riser pipes extend through a stacked deck of novel spacers resting on the gravity base. The spacers are also supported from the floating platform so that the gravity base can be lowered independently of the lowering of the spacers. The lower end of each individual riser pipe is called a "riser terminator," which is normally of a substantially larger diameter than the rest of the riser so that it can withstand the added induced stresses concentrated at that point of the riser pipe. The spacers have openings which are sufficiently large to permit the larger riser terminators to pass through as the gravity base is lowered. This is accomplished by the addition of new joints of riser pipes being added above the deck to the existing riser pipes connected to the gravity base and then lowered somewhat in the fashion of lowering casing in a wellbore; but, here, it is done in bundles or groups for each leg of the platform. There are usually four legs to a platform. As the bundle of risers is lowered, it will reach a point where it is desired to have a spacer installed. At this point, the lower centralizer of the stack of spacers is actuated. This is done by having hydraulically driven rods centralize each riser in its spacer hole within the centralizer. Then, two semicircular clamps are hydraulically closed and locked around each riser to fill the space between the riser and the spacer plate which was made large enough to permit the larger riser terminator to pass through. Means are provided so that once the lower spacer of the stack is actuated to engage the individual risers, it can be released from the surface support and lowered with the risers. The rest of the stack of spacers remains in position. The anchor base and the lower spacer are lowered by the addition of joints of risers to each of the risers in the leg under consideration and is continually lowered until the point at which it is desired to place a second spacer on the leg. Then the above-described procedure is repeated.

Various objects and a better understanding of the invention can be had from the following description taken in conjunction with the drawings.

DETAILED DESCRIPTION OF THE DRAWINGS

Figure 1:
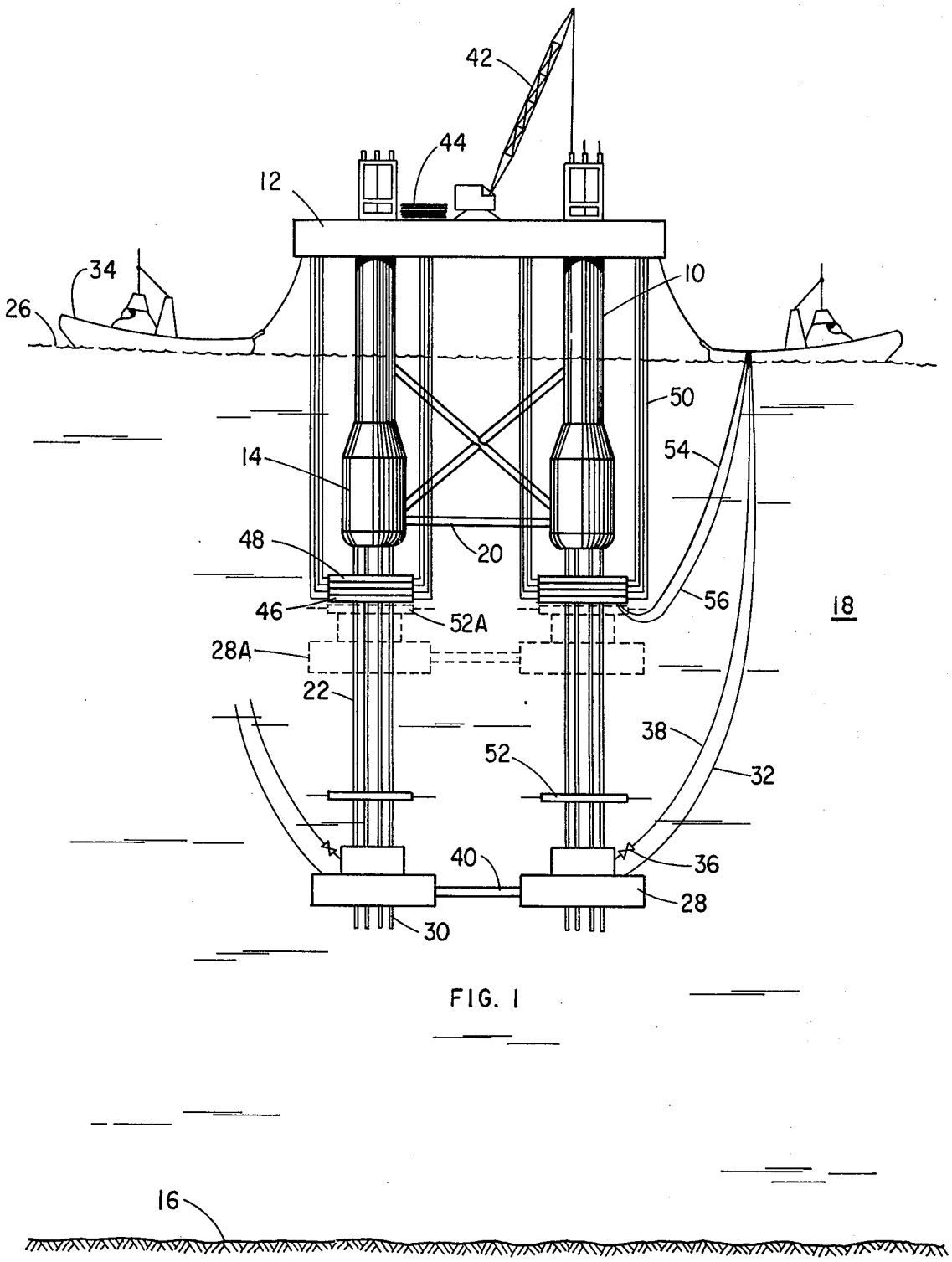
FIG. 1 is a view of a floating structure utilizing this invention.

Referring to the drawings as shown, floating structure or drilling platform 10 is supported on a body of water 18, having a bottom 16. The structure 10 generally includes a deck means 12 supported by buoyant means 14, which, in the particular configuration shown, includes four bottle-shaped float members which are connected by bracing 20. The floating structure shown is commonly called a "Vertically Moored Platform," and is preferably built along the design described in U.S. Pat. No. 3,648,638, supra. The anchoring means are indicated as items 28 having punch tubes 30 at the lower end. The anchoring means can be large masses such as steel tanks filled with a heavy fluid, or even concrete. These anchor base means 28 are connected through four legs 22 to the float members 14. Each leg 22 comprises a bundle or plurality of large-diameter pipe called riser pipes. These riser pipes are normally made of high-quality steel and typically are 20 inches, or more, in diameter. The particular bundle of riser pipes for each leg can vary in number from four to eight, and are indicated in the drawings as being eight in number.

Anchor base 28, as shown, is any mass which can be lowered to the bottom 16 and be of sufficient magnitude to withstand the forces exerted thereon. There is a punch tube 30 for each riser pipe 22A. The riser pipe is connected into a vertical passage through gravity base 28, which is aligned with a punch tube 30. The drilling operation is conducted through the riser 22 and punch tubes 30. Gravity base 28 can be a container and a high-weight drilling fluid can be injected through line 32 from ship 34, and water can be expelled through valve 36 controlled by line 38 from the vessel 34. Various-type gravity bases or anchoring means can be provided; however, the particular kind is not a part of this invention. The gravity bases 28 for the various legs are preferably connected by cross members 40.

Also shown in FIG. 1 is a crane 42 which is used for lowering the riser pipes. A stack of riser pipe joints 44 is also indicated. Any suitable means for holding the riser pipes, attaching additional joints to the riser pipes and lowering them as a unit, is satisfactory. The art of adding joints to drill pipe and casing, etc., is well developed. The supply vessels 34 also are used to keep the floating vessel or drilling ship 10 in position until the anchor base 28 is in anchoring contact with the bottom 16.

Dotted lines 28A indicate the position of the gravity base before the lowering operation of the gravity base is begun. Supported on gravity bases 28A is a stack of spacers 46, having individual spacers 48. These are held to deck 12 by lines 50. They are also supported on top of the gravity base 28A while under tow.

Figure 2:
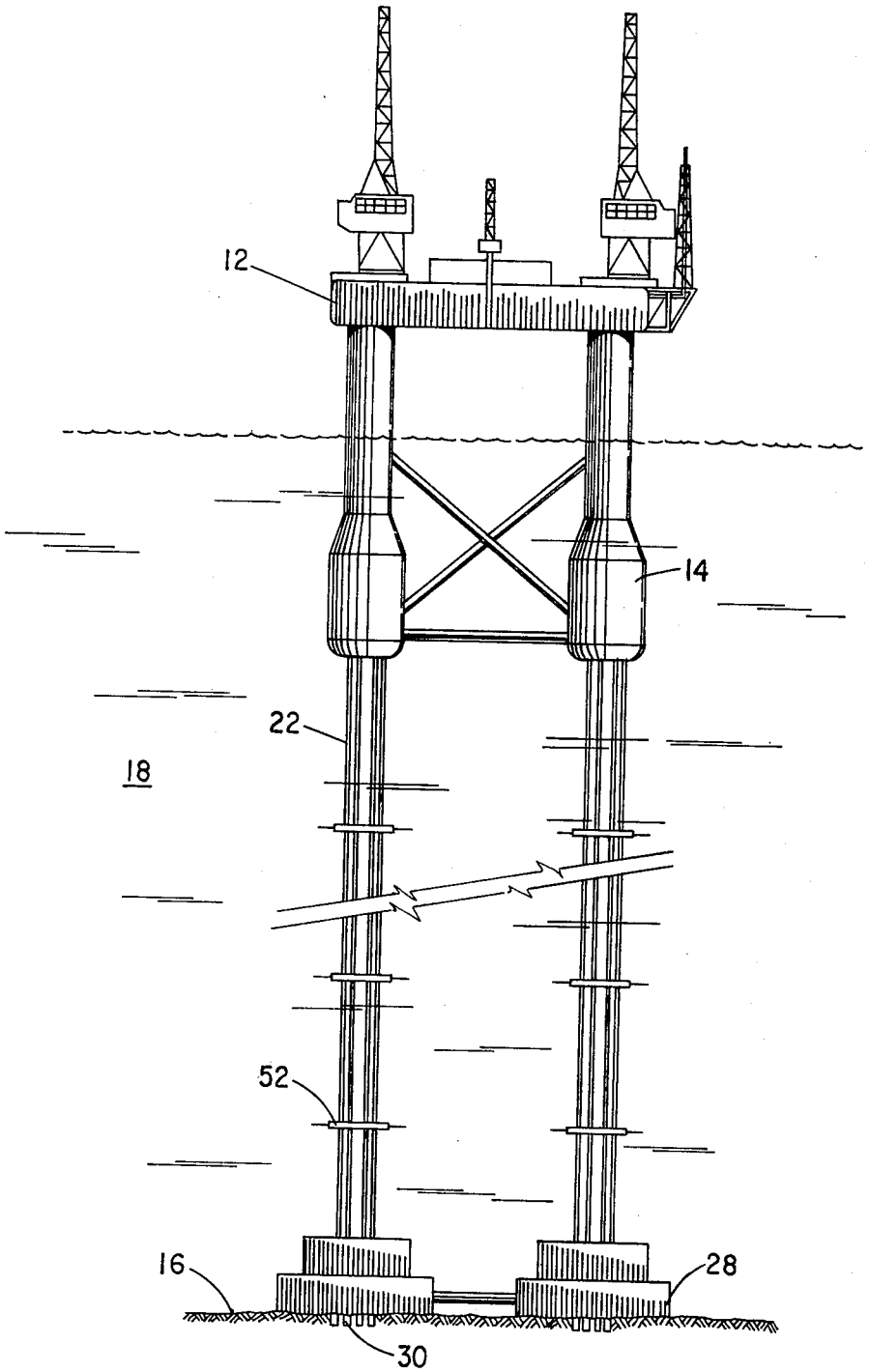
FIG. 2 shows a floating structure with spaced riser pipes extending from the floating structure to the anchor in the sea floor.

To briefly recapitulate, in the device of FIG. 1, there is a floating structure 10 having a deck 12, which supports riser pipes 22, which are attached at the lower end to gravity bases 28A, which will eventually be the anchoring means. While being towed to operation, spacers 46 are stacked on top of the gravity base 28A. Once in position, additional joints of pipes 22 are added to each riser pipe at the surface and lowered by means of crane or other well known means. The riser pipes pass down through openings in the spacers 48. When gravity base 28 is lowered to a preselected level, the lower spacer 52 is actuated to secure each of the riser pipes 22 in a selected, spaced relationship. Then the vertical lines 50 are released from the lower spacer 52. The spacer 52 is then lowered with the riser pipes to the position shown in FIG. 1. Lower spacer 52 is indicated as 52A and is outlined in dotted line. Each spacer includes a control line from vessel 34. As indicated, this can be hydraulic control lines 54 and 56. FIG. 2 illustrates a typical Vertically Moored Platform with the anchor base 28 resting on the bottom 16. The spacers or centralizers 22 are properly fixedly positioned vertically along the riser pipes.

Having described the setting and function in the process of the Vertically Moored Platform, attention will now be directed to FIGS. 3 through 8 to show the novel centralizers or spacers of this invention.

Figure 3:
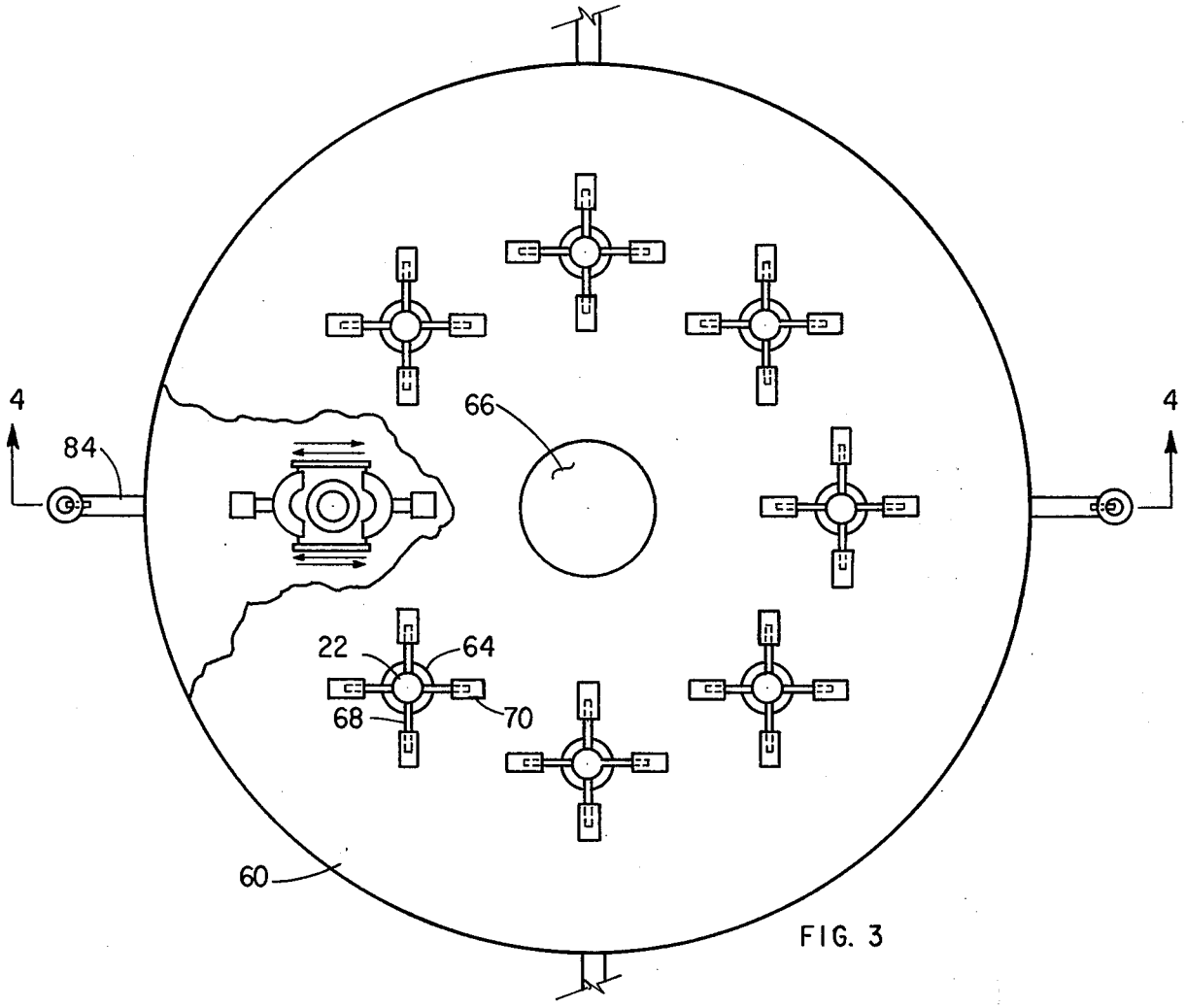
FIG. 3 is a plan view of a spacer of this invention for use with one bundle of risers.
Figure 4:
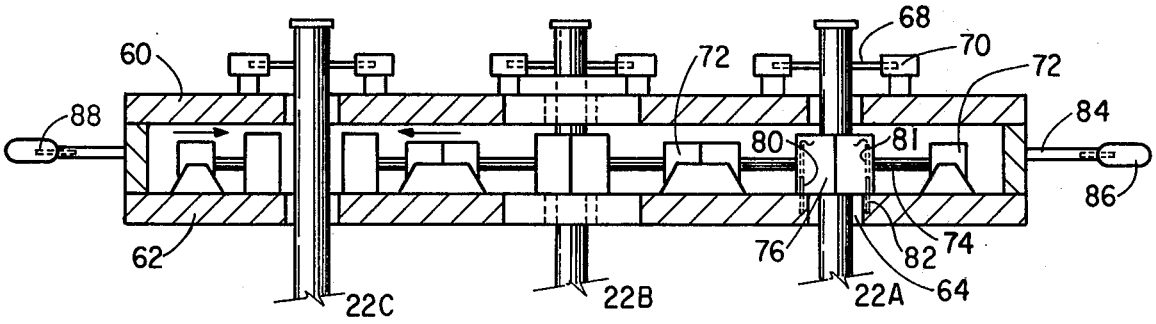
FIG. 4 is a partial section view taken along the line 4—4 of FIG. 3.
Figure 8:
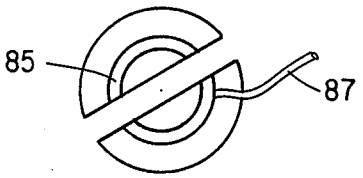
FIG. 8 illustrates another clamping modification.

As I taught above, my spacers contain holes or vertical passages for the large-diameter terminator ends of the riser pipe to pass. I use preferably hydraulic cylinders to centralize each riser in the spacer hole, and then I use two semicircular clamps to lock around each riser to fill the space between the riser and the spacer plates and to hold it in a snug position. It may not always be necessary to obtain this "snug" fit, e.g., the clamps may rest on or between shoulders on each riser pipe. Reference is now made to FIGS. 3 through 7 to describe a preferred form of centralizer. Attention is now directed specifically to FIGS. 3 and 4. Shown thereon, is an upper circular plate 60 and a lower circular plate 62. These plates are provided with vertically aligned holes 64 through which risers 22 may pass. Plates 60 and 62 do not need to be solid disks and can be made in any way to reduce the weight yet retain strength. For example, a central hole 66 may be provided therethrough.

Figure 5:
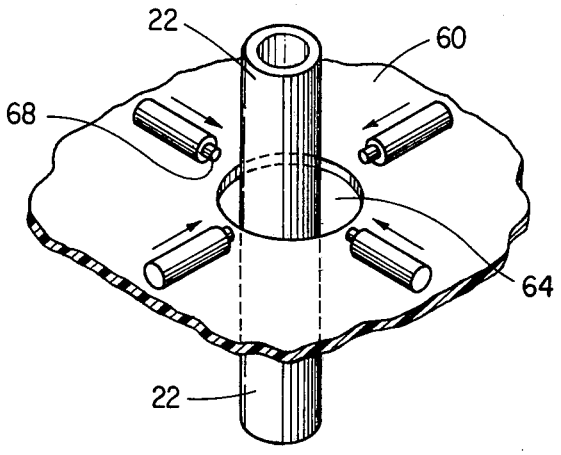
FIG. 5 is a cutaway view of one passage in the spacer showing rods for centralizing the riser.
Figure 6:
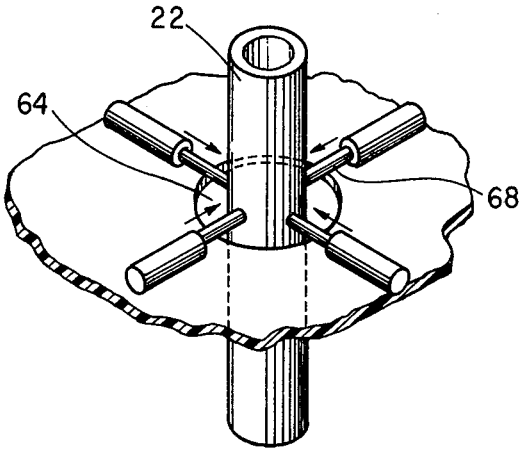
FIG. 6 is similar to FIG. 5, except the rods have been extended and the riser centralized.

As the riser pipes 22 are smaller than the hole 64, I provide centralizer arms. For each hole 64, I provide four centralizing arms 68, powered by remotely controlled power means 70, which may be hydraulic cylinders having hydraulic hose, such as 54 (as shown in FIG. 1), extending to a support vessel 34. The four centralizing arms are so designed that they are unable to push the riser past the center from any side. That is, for a 20-inch riser in a 34-inch hole, the arms 68 should not extend more than 7 inches past the edge of the large hole 64. FIG. 5 is fragmentary view of part of plate 60 and shows the hydraulic or centralizing arms 68 in a retracted position. FIG. 6 shows the centralizer arms 68 in an expanded position, pushing riser pipe 22 to the center of hole 64.

I shall now describe means for clamping the riser pipes 22. This is shown in FIG. 4 between upper plate or frame 60 and lower frame 62. This includes two hydraulic motors 72. Hydraulic motors 72 have arms 74 attached to semicircular clamp 76. In FIG. 4, the clamps 76 are shown as engaging riser 22A and 22B, but are not engaging riser 22C. On riser 22C, the clamps have not yet been actuated. These clamps are actuated remotely from the surface by any known means, such as hydraulic lines 56 from a surface vessel 34. (For example, there may be an individual line to each hydraulic motor.) If desired, spring or pressure-loaded dogs 80 can be provided in each arm 76 and, when aligned with holes or detents 82, would lock the semicircle 76 in place. Then the hydraulic pressure to the motor 72 can be released. It is, of course, to be understood that latching pins 80 are not absolutely necessary. If it is desired to be able to remove or pull the riser through the device, there must be means to release the clamps 76. I can provide means to release pin or dogs 80 by use of solenoid 81 or similar device if dogs 80 are used. Then drive motor 72 can be double-acting and selectively provided with a hydraulic fluid to drive the semicircle 76 either into a closed or open position.

I will now discuss one means of releasing each line 50 from its respective spacer. The spacer frame, as shown in FIGS. 3 and 4, is provided with extending arms 84, which are connected to link 86 by shear pin 88. Link 86 is connected to line 50, as shown in FIG. 1. The function of shear pin 88 is to release lines 50 from the individual centralizer after the centralizer has been firmly connected to the riser pipes. This can be accomplished either by pulling up on the line 50 or by just holding firm and letting the anchor base be lowered by lowering risers 22. Once shear pin 88 has been sheared, the accompanying line 50 can be withdrawn and removed from the vicinity. Other means of releasing the lines 50 can be used, e.g., pins 50 can be released electrically or mechanically.

Figure 7:
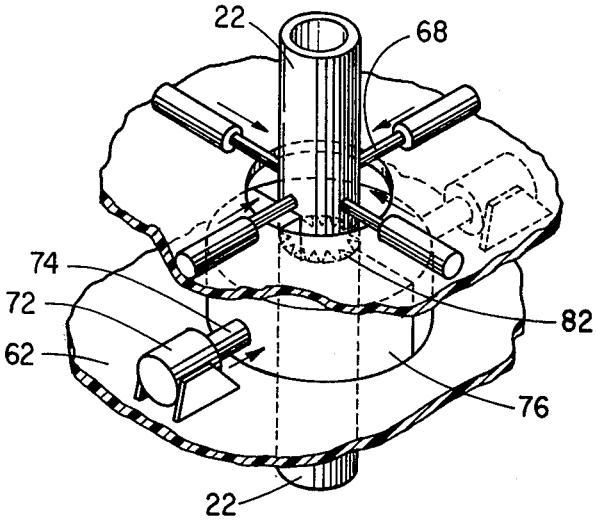
FIG. 7 is a partial view of a spacer illustrating one vertical passage and one riser pipe therethrough, centralized and clamped in position.

Attention is directed to FIG. 7, which shows in perspective the centralizing arms 68 and clamping means 76. In FIG. 7, the semicircular clamps 76 are provided with teeth 82 which can be any type slips to engage the pipe 22. Sometimes, it may be desired not to scar the riser pipe 22 in any manner, yet still have it clamped in position. This can be obtained by the slight modification illustrated in FIG. 8. Shown there, instead of teeth or slips 82, I have indicated inflatable bag 85, inflatable through lines 87. A Hydril-type bag is believed suitable, such as used in the Hydril Blowout Preventer made by Hydril Company, Los Angeles, California.

While the preferred embodiment has been described in a great deal of detail, it is possible for various variations therein without departing from the spirit or scope of the invention.

I claim:

1. A spacer for use with a bundle of a plurality of riser pipes used between a vessel floating on a body of water and the bottom thereof which comprises:

a. a frame means having a plurality of vertical passages therethrough, there being a passage for each said riser pipe;

b. first means remotely operable for centering each said riser pipe after it is extended through its vertical passage; and c. second means for securing each said riser to said frame means.

2. A spacer as defined in claim 1, in which each said vertical passage is circular in cross section, and wherein said first means includes a plurality of arms directed toward the center of said vertical passage, the arms being limited to extend into the passageway a distance equal to one-half the difference in diameter between said riser pipe and said vertical passage.

3. A spacer as defined in claim 1, wherein said second means includes two blocks, each connected to a hydraulic arm, the inner end of said block having a cross section shaped as a semicircle to engage said riser pipe.

4. A spacer as defined in claim 3, in which said semicircle portion is provided with an inflatable bag and including means to inflate said bag.

5. A spacer as defined in claim 3 including means to lock said blocks in their innermost position.

6. A spacer as defined in claim 5 including means to release said blocks from their locked position.

* * * * *